United States Patent [19]

Kuchelmeister

[11] Patent Number: 4,484,621

[45] Date of Patent: Nov. 27, 1984

[54] TUBE AND RIB HEAT EXCHANGER

[75] Inventor: Reinhold Kuchelmeister, Waldenbuch, Fed. Rep. of Germany

[73] Assignee: Sueddeutsche Kuehlerfabrik Julius Fr. Behr GmbH & Co. KG, Stuttgart, Fed. Rep. of Germany

[21] Appl. No.: 363,767

[22] Filed: Mar. 31, 1982

[30] Foreign Application Priority Data

Apr. 15, 1981 [DE] Fed. Rep. of Germany ..... 3115189
Jan. 29, 1982 [DE] Fed. Rep. of Germany ..... 3202901

[51] Int. Cl.[3] ..... F28F 9/00; F28F 1/32

[52] U.S. Cl. ..... 165/67; 165/69; 165/149; 165/151

[58] Field of Search ..... 165/67, 69, 149, 151, 165/129

[56] References Cited

U.S. PATENT DOCUMENTS

| | | | |
|---|---|---|---|
| 2,168,549 | 8/1939 | Young | 165/149 |
| 2,599,965 | 6/1952 | Young | 165/151 X |
| 3,263,746 | 8/1966 | Becher et al. | 165/67 X |
| 3,369,595 | 2/1968 | Nelson | 165/67 X |
| 3,795,274 | 3/1974 | Fieni | 165/67 X |
| 3,847,213 | 11/1974 | Stich | 165/129 X |
| 4,036,288 | 7/1977 | Neveux | 165/151 X |
| 4,300,628 | 11/1981 | Melnyk | 165/149 |
| 4,428,418 | 1/1981 | Beasley et al. | 165/76 |

FOREIGN PATENT DOCUMENTS

| | | | |
|---|---|---|---|
| 2460035 | 6/1976 | Fed. Rep. of Germany | 165/149 |
| 2042437 | 2/1971 | France . | |
| 52-30962 | 3/1977 | Japan | 165/149 |
| 818589 | 8/1959 | United Kingdom . | |
| 2054125 | 2/1981 | United Kingdom . | |

*Primary Examiner*—Sheldon J. Richter
*Attorney, Agent, or Firm*—Schwartz, Jeffery, Schwaab, Mack, Blumenthal & Koch

[57] ABSTRACT

Disclosed is a heat exchanger, preferably for use in automotive vehicles, comprising a plurality of parallel tubes and a plurality of ribs extending the tubes, together with lateral parts fastened to the ends of the ribs. According to the invention, the lateral part consists of a strip applied against the ends of the ribs and joined with the ribs by means of an adhesive or by the embedding of the rib ends into the material of the strip. Also disclosed is a process for the manufacture of heat exchangers of this type.

17 Claims, 21 Drawing Figures

Fig. 11a
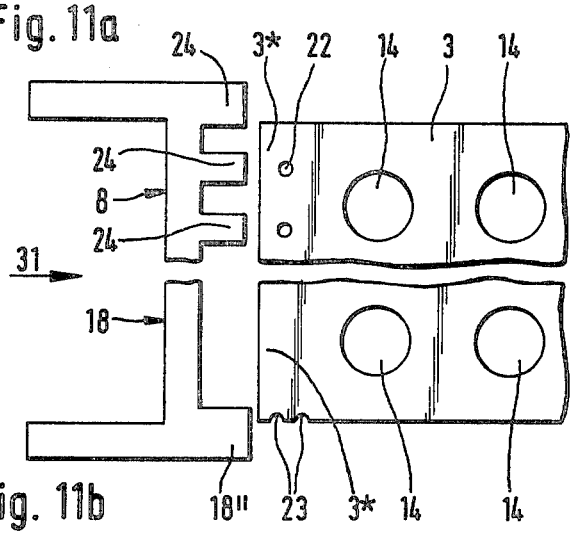
Fig. 11b
Fig. 12
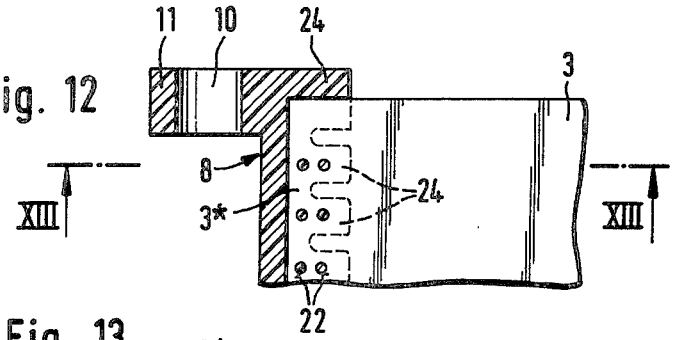
Fig. 13
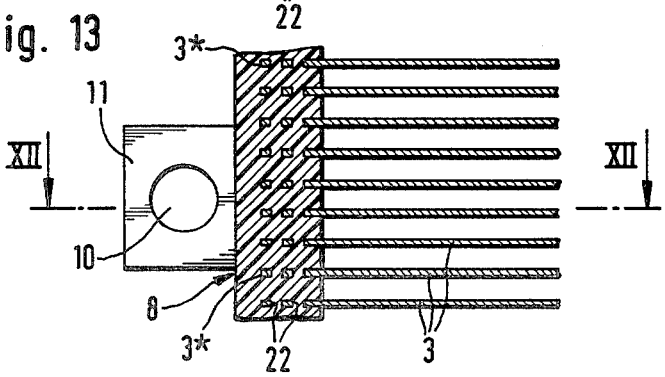

TUBE AND RIB HEAT EXCHANGER

BACKGROUND OF THE INVENTION

The present invention relates to a heat exchanger. In particular, the present invention relates to a heat exchanger for use in automotive vehicles. Also, the present invention relates to a process for the manufacture of heat exchangers for use in automotive vehicles.

A heat exchanger having lateral parts fastened to the radiator core by means of a solder joint is described in U.S. Pat. No. 2,599,965. According to this reference, the lateral parts are essentially in the shape of a C and engage the ribs by means of profiled edge grooves provided laterally in the ribs. Since only the 4 corners of the radiator core are immersed in liquid solder, only a limited number of ribs, and thus a relatively small joining surface, is available for soldering. In a further measure, parts of the ribs are bent over to increase the usable joining area, and the bending is effected in the same location on all of the ribs so that the grooves for the insertion of the lateral parts are formed automatically. This modification results in only a slight improvement in soldering capability. In order to insure that the grooves are not excessively wide, since joining with the lateral part by soldering would then become impossible, the bent surfaces must be very small. In this design, it is essential to provide a defined gap for the satisfactory soldering of the lateral parts to the ribs. A joint of this type is not suitable for exposure to large forces. Furthermore, in this known arrangement, the lateral parts must be made of a solderable material, i.e., metal. Furthermore, the attachment of a partial lateral part which does not extend over the entire height, is not possible.

SUMMARY OF THE INVENTION

It is therefore an object of the present invention to provide an improved heat exchanger.

An additional object of the present invention is to provide a heat exchanger having an improved attachment relationship between the rib packet and the lateral parts.

A further object of the present invention is to provide a heat exchanger having lateral parts made of nonsolderable material.

Another object of the present invention is to provide a heat exchanger having lateral parts requiring only partial attachment to the rib packet.

Yet another object of the present invention is to provide for the attachment of the lateral parts at any location along the sides of the rib ends.

Still another object of the present invention is to provide for the attachment of the lateral parts to the rib ends in a simple manner.

Additionally, another object of the present invention is to provide a process for the manufacture of a heat exchanger of the type described above.

In accomplishing the foregoing objects, there has been provided in accordance with one aspect of the present invention a heat exchanger, particularly for use as a radiator in an automotive vehicle, comprising a plurality of tubes, a plurality of ribs extending in a transverse direction to the tubes, means for receiving and transporting a heat exchange medium through the tubes, and means for mounting the heat exchanger comprising at least one strip attached to the ends of the ribs to form the lateral part of the heat exchanger. Attachment is either by adhesive bonding or embedding the rib ends in the strip In a preferred embodiment of the present invention, there is included at least one angled part in the area of the rib ends, the angled parts forming a surface extending in a direction approximately perpendicular to the longitudinal direction of the ribs, the surface providing area for attachment to the strips.

In accordance with another aspect of the present invention, there is provided a process for the manufacture of a heat exchanger, comprising the steps of providing a plurality of ribs, each having at least one angled part in the area of the end of the ribs, the angled parts forming a surface approximately perpendicular to the longitudinal direction of the ribs, covering the surface with adhesive tape coated on both sides, attaching a strip onto the other side of the tape, pressing the strip to the tape, and hardening the adhesive, preferably by heating, to form a bond between the strip, the adhesive and the rib.

In a preferred embodiment, the strips include projections on the side of the strip facing the ribs for engaging the ribs and the process further comprises the steps of softening the projections prior to engagement with the rib ends, engaging the softened projections and embedding the rib ends in the strip to form a bond and hardening the projections to the original solid state.

Further objects, features and advantages of the present invention will become apparent from the detailed description of preferred embodiments when considered with the drawings which follow.

BRIEF DESCRIPTION OF THE DRAWINGS

In the drawings:

FIG. 12 illustrates a rib embedded in the material of the profiled strip according to the line XII—XII in FIG. 13, FIG. 13 is a partial longitudinal cross section of a lateral part with rib ends embedded therein, taking along the line XIII—XIII in FIG. 12.

DETAILED DESCRIPTION OF PREFERRED EMBODIMENTS

Figure 1:
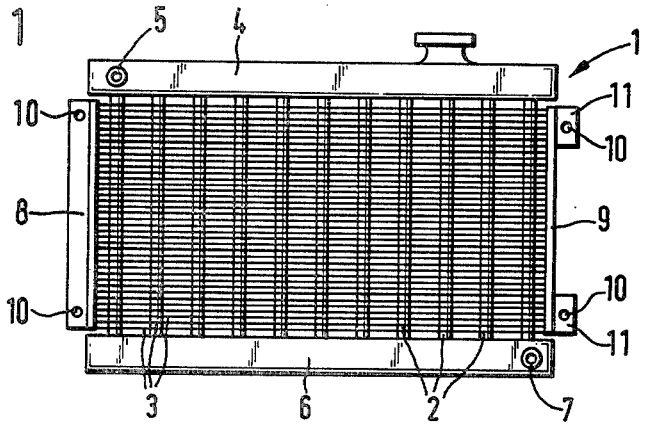
FIG. 1 is a schematic front view of an automotive radiator.

FIG. 1 shows a radiator 1 designed in the downdraft mode, comprising a plurality of tubes 2 and ribs 3 extending transversely to the tubes 2. The ends of the tubes open into an upper water tank 4 having an inlet 5 and a lower water tank 6 having an outlet 7. Strips 8 and 9 fasten to the rib ends. These strips are referred to herein as the lateral parts. The strip 8, shown on the left, has the configuration of a profiled strip with mounting holes 10 for the installation of the radiator in the vehicle. The strip 9, shown on the right, is equipped with tabs 11, having mounting holes 10. The tabs 11 may be attached, as needed to a suitable location of the strip 9 prior to the fastening of the strip 9 of the rib ends. The strips 8 and 9 are located at an adequate distance from the water tanks 4 and 6, so that even in the case of extreme length variations due to temperature conditions, there is no contact of the water tanks with the strips 8 and 9.

Figure 2:
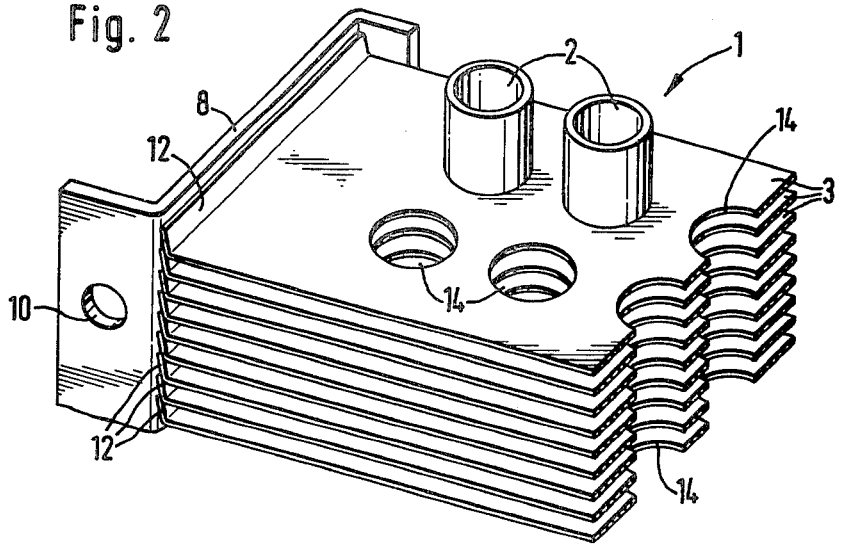
FIG. 2 is a perspective view of an enlarged section of several rib ends.

FIG. 2 is a perspective and substantially enlarged view of the ends of a section of the stacked ribs 3. The ribs 3 have angled parts 12 at their ends, with the angled ends 12 of all of the ribs 3 pointing in the same direction and partially overlapping. The angled parts 12 form a surface 13 perpendicular to the longitudinal direction of the ribs 3, as may be seen in FIG. 3. It should be noted that the thickness of the sheet metal of the ribs is usually of the order of tenths of millimeters, and that therefore, the unevenness of the surface 13 is negligibly low. A profiled strip 8 is attached to the rib ends, with the surface 13 serving as the joining surface for adhesive bonding.

Figure 3:
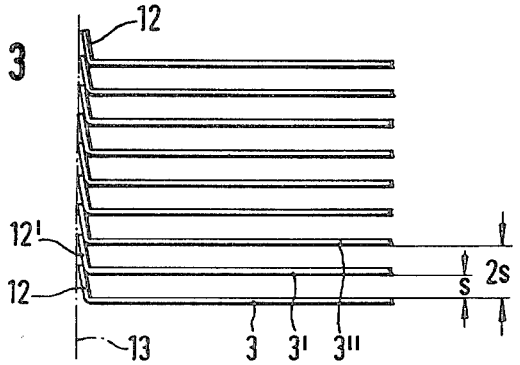
FIG. 3, is a front elevation of certain stratified rib ends.

In FIG. 3, a few ends of the stacked ribs 3 are shown as viewed from the side of the radiator. The normally uniform distance of the rib 3 from the next rib 3' is designated by s. The distance of the rib 3 from rib 3'' is 2s, with the slight thickness of the rib 3' being negligible. The angled parts 12 are at approximate right angles to the ribs 3 and extend sufficiently as to overlap with the next angled part 12' The angled parts 12 form, in their entirety, an approximately flat surface 13. The overlap of angled parts 12 insures that the angled parts are not bent into the spaces between the ribs 3, 3' and 3'' during the pressing of the strips 8.

Figure 4:
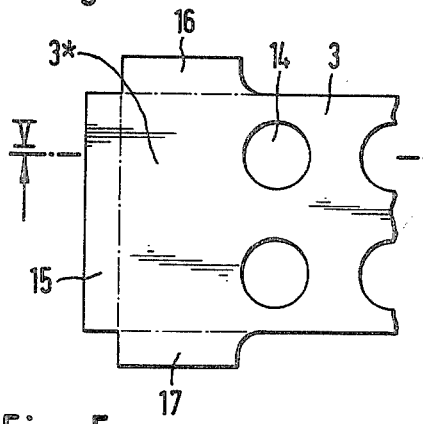
FIG. 4 is a top view of a rib end prior to the angling of the connecting surfaces.

FIG. 4 shows the end portion 3* of a rib 3 having tabs 15, 16 and 17 which protrude past the dimension of the rib 3 itself. The tabs are simultaneously bent at an angle during the stamping of the orifices 14 resulting in angled parts 15', 16' and 17'. FIG. 4 also illustrates the orifices 14 provided for the reception of the tubes 2.

Figure 5:
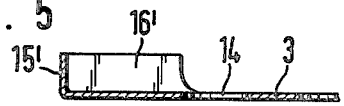
FIG. 5 is a cross section taken along lines V—V of FIG. 4, with the surfaces already bent over.

FIG. 5 illustrates a cross sectional view taken along line V—V of FIG. 4, wherein the rib end 3* is shown with the parts 15' and 16' already bent at an angle.

Figure 6:
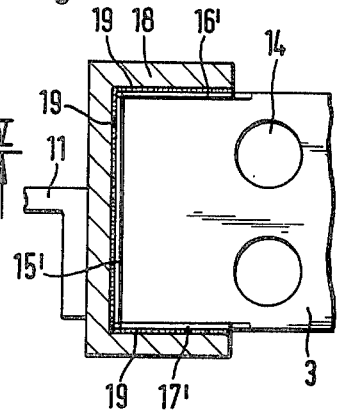
FIG. 6 is a cross section through a profiled strip with the end of a rib attached to it according to FIGS. 4 and 5.

As seen in FIG. 6, the three parts 15', 16' and 17' form three joining surfaces corresponding to the aforementioned surface 13. These surfaces are located at right angles to each other, resulting in the shape of a U. A profiled strip 18 corresponding to this U shape is joined with the three surfaces by means of an adhesive layer 19. The shaped strip 18, as indicated in FIG. 6, may be equipped with tabs 11 on the outside for the attachment of the radiator to the vehicle.

Figure 7:
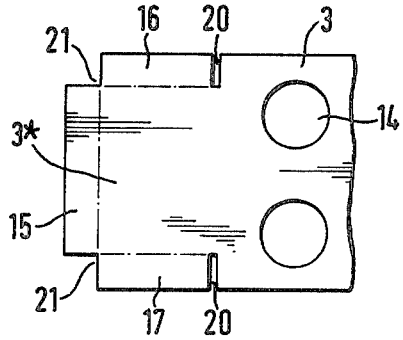
FIG. 7 is a variation of FIG. 4.

Referring now to FIG. 7, there is shown end 3* of rib 3, provided with notches 20 and 21. The notches 20, 21 define the parts to be bent over, e.g., tabs 15, 16, and 17, as shown in FIG. 4.

Figure 8:
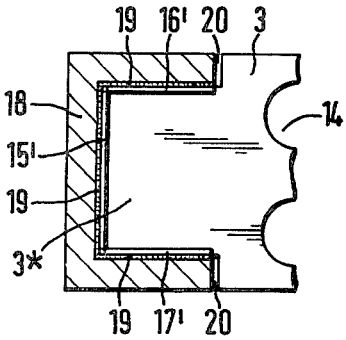
FIG. 8 is a cross section through a profiled strip with the end of a rib fastened to it according to FIG. 7.

FIG. 8 essentially corresponds to FIG. 6; however, the U-shaped profile strip is adapted in its external dimension to the width of the ribs.

Figure 9:
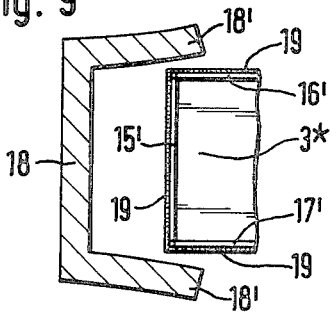
FIG. 9 is an expanded profiled strip during the assembly period.

FIG. 9 shows how the U-shaped strip 18 is spread by its legs 18' and then pushed onto the surfaces of the rib ends 3* provided with an adhesive layer. The profiled strip 18 is pressed against the angled parts 15 and the spreading is then eliminated, thus providing additional pressure for urging the strip against the parts 16' and 17' through the springback of the legs 18'.

Figure 10:
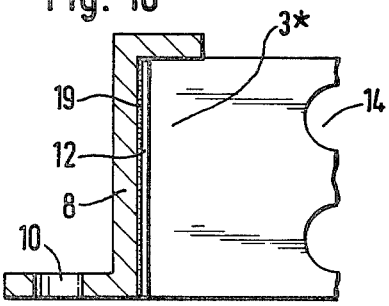
FIG. 10 is a cross section through a profiled strip and a rib end attached to it, according to FIG. 2, FIGS. 11*a* and 11*b* represent two embodiments of profiled strips and rib ends prior to embedding.

In FIG. 10 is shown a strip 8 essentially corresponding, with respect to its cross-sectional configuration, to the S-shaped profiled strip shown in FIG. 2. The profiled strip 8 is equipped in its center part for attachment to the angled parts 12. One end of the cross-sectional configuration is at right angles to the center part to form a lateral support surface for the ribs 3. The other end of the cross-sectional configuration is angled in the opposite direction and contains the aforementioned fastening holes 10. This angled end of the shaped strip may also serve, for example, as a limit stop to define a certain position in the vehicle, or as a compensating element for compensating for the differential distances of the radiator from the vehicle body, or as a so-called secondary air cover or as a fastener for other assemblies.

FIG. 11*a* shows a section of a rib 3, exhibiting a plurality of holes 22 in the area of the rib end 3*. In front of the rib end 3* there is located an essentially U-shaped strip 8, being equipped on the side facing the rib end 3* with a plurality of projections 24. The projections 24 are arranged to correspond to the distance from the edge of rib 3 to the holes 22.

FIG. 11*b* illustrates a section of a radiator rib having two notches 23 arranged along the longitudinal side of the rib end 3*. In front of the rib end 3* there is located an H-shaped profile strip 18, having arms 18'' extending in the direction of the radiator rib 3*. The arms 18'' at profile 18 are formed so that the rib end 3* is embedded in the arms 18'' in a manner such that arms 18'' receive the notches 23.

Arrow 31 indicates the direction in which the strip 8 and 18, respectively, is moved during the embedding of the rib ends 3* into the material of the strip 8 and 18, respectively.

FIG. 12 represents the rib end 3* of a heat exchanger rib 3 embedded in the material of a strip 8, with the strip 8 having approximately the same configuration as that of FIG. 11*a*. As seen in FIG. 12, in the embedded state of the rib end 3*, the projections 24 are located in the area of the holes 22 arranged in the rib 3, so that the softened synthetic plastic material of the strip 8 is able to penetrate through the holes 22, thereby creating a positive joint. The reference 11 designates a tab, with a fastening hole 10 arranged in it.

FIG. 13 shows a section on the line XIII—XIII in FIG. 12. This view illustrates the manner in which the stacked ribs 3 are embedded with their rib ends 3* in the material of the strip 8 and how the positive joint is obtained by means of the holes 22.

Figure 14:
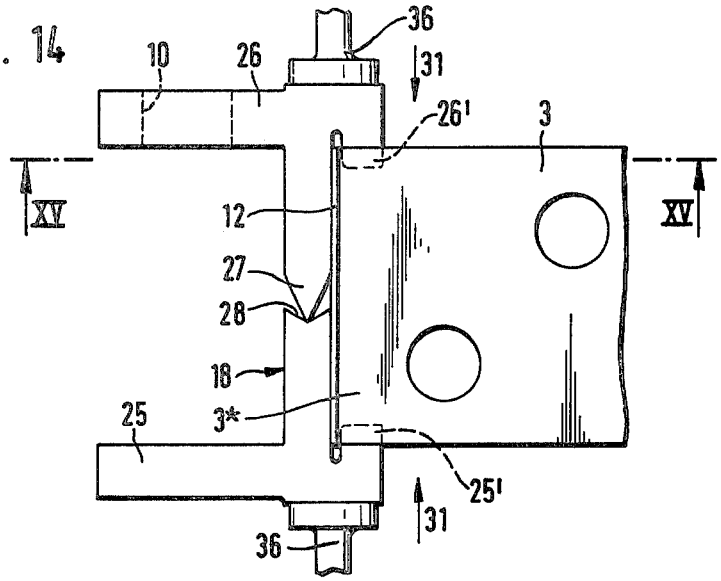
FIG. 14 illustrates a profiled strip fastened to angled rib ends by means of embedding, wherein the profiled strip is in two parts.

FIG. 14 illustrates a rib 3 embedded in a profiled strip 18, with the profiled strip 18 comprising two parts 25 and 26. The rib 3 has an angled part 12, as described in connection with FIGS. 2 and 3. The parts 25 and 26 of the shaped strip 18 have a configuration such that they engage the rib 3 behind the angled parts 12 with their projections 25' and 26' directed at the longitudinal center axis of the rib 3. The rib end 3* is embedded merely in the projections 25' and 26'. The partition plane of the profiled strip 18 extends in the longitudinal direction of the strip. The part 25 comprises a V-shaped notch 28 and the part 26 comprises a V-shaped projection 27 in the partition plane. The angle of the V-shaped projection 27 is substantially less than the opening angle of the notch 28. By means of this configuration, the assembly acts as a swivel bearing, whereby the parts 25 and 26 may be pivoted to a limited extend, with respect to each other. The arrows 31 indicate the direction of motion of the projections 25' and 26' during the embedding.

In order to fasten the strip 18 to the core of the heat exchanger, the parts 25 and 26 of the strip 18 are fitted against the rib ends 3* by their projections 25' and 26'. A sonotrode 36 is placed onto each of the parts 25 and 26 in the area of the projections 25' and 26', whereby the vibrational energy is transmitted to the parts to be welded. In this manner heating is generated in the boundary layers of the projections 25' and 26' and in the area of the joining areas of the parts 25 and 26 leading to the softening of the material of the strip 18, whereby the projections 25' and 26' are moved in the interstitial spaces of the rib ends 3* by means of a suitable advance and a displacement of the parts 25 and 26 in the direction of the arrows 31 is effected. In this manner the parts 25 and 26 are brought into contact and simultaneously welded in the area of the partition plane.

Figure 15:
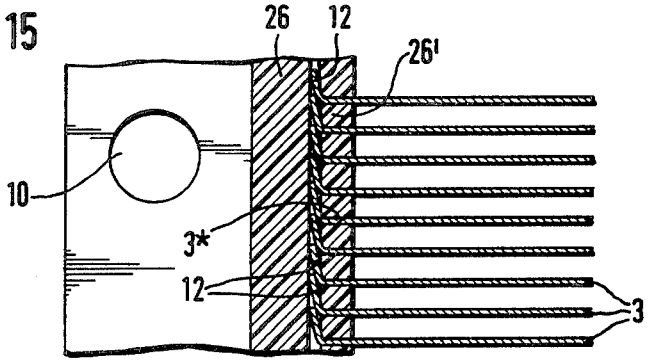
FIG. 15 is a cross section taken along the line XV—XV in FIG. 14.

FIG. 15 represents a cross-section on the line XV—XV in FIG. 14. This representation shows that a plurality of ribs 3 with overlapping angled parts 12 are embedded in the material of the parts 26 and 26', respectively, of the strip 18.

By the clamping of the angled parts 12, following the embedding of the rib ends 3*, between the part 26 and the projection 26', a positive joint of the ribs 3 with the strip 18 is obtained.

Figure 16:
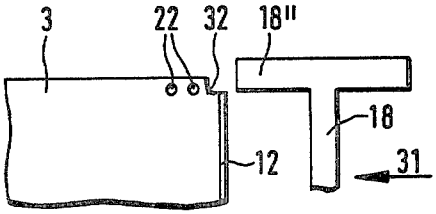
FIG. 16 is a variant of the embodiment of FIG. 11*a*.

In FIG. 16 is schematically illustrated a section of a rib 3 with an angled part 12, to which an H-shaped profile strip 18 is to be applied in the direction of the arrow 31. In order to enable the arm 18" of the profiled strip 18, extending in the direction of the rib 3, to enter the space between the ribs 3 in the softened state, a recess 32 is provided in the lateral area of the angled part 12. Holes 22 are provided for the positive joining of the rib 3 with the strip 18, the holes being located laterally adjacent to the angled part 12, when viewed in the direction of the insertion of the strip 18.

Figure 17:
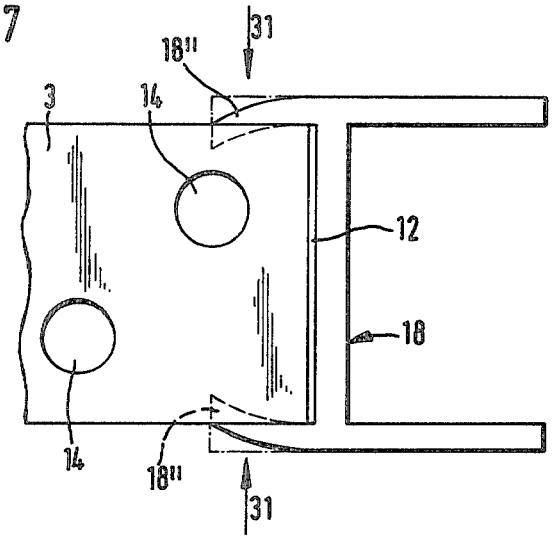
FIG. 17 illustrates an angled rib end embedded in an integrally-formed profiled strip.

FIG. 17 illustrates a rib 3, carrying an angled part 12 on its end. The embedding of the rib 3 into an H-shaped profile strip 18 in this case is effected in the softened condition by moving the arms 18" which laterally extend adjacent to the rib 3 toward each other in the direction indicated by the arrows 31. In this manner, a positive joint of the ribs 3 with the profiled strip 18 is obtained, without a need for the holes 22 shown in FIG. 16.

Figure 18:
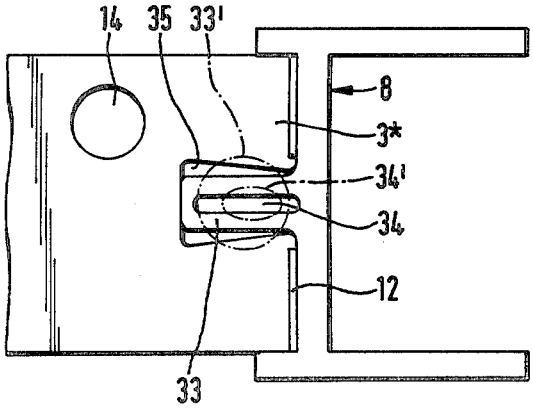
FIG. 18 represents the mode of fastening of a lateral part engaging the recesses of the rib ends.

An arrangement wherein the rib ends 3* have a dovetail shaped opening 35, thereby forming a groove along the radiator core, is illustrated in FIG. 18. A projection 33 of the synthetic plastic strip 8 engages the groove, with the projection 33 having a channel 34 extending in the longitudinal direction of the strip 8. In order to embed the rib ends, the material of the projection 33 is softened and simultaneously pressure is built up in the channel 34, whereby the material of the projection 33 penetrates into the interstitial spaces of the rib ends 3*. The broken lines 33' and 34' indicate the shape of the strip subsequent to embedding.

Figure 19:
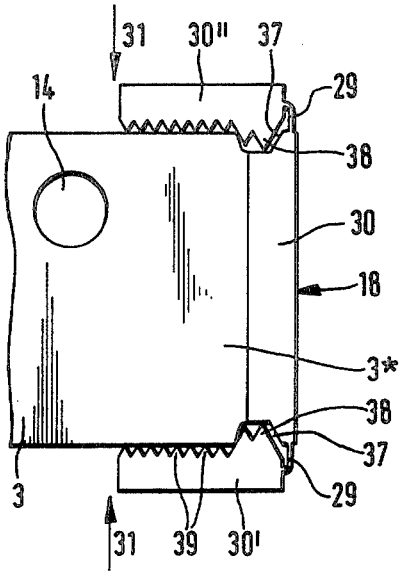
FIG. 19 illustrates a rib end with a profiled strip in three parts.

FIG. 19 shows a rib end 3* with a strip 18 comprising three parts 30, 30', 30". The strip 18 is in the shape of a U, with the web being designated by 30 and the legs by 30' and 30". The legs 30' and 30" are connected with each other by means of film hinges 29. The center part (web) 30 has at each of its ends a recess or depression 37, each being engaged by a projection 38 of the legs 30', 30". The legs 30', 30" carry a plurality of projections on their sides facing the ribs 3. The sonotrodes of the ultrasonic welding apparatus are applied as described in connection with FIG. 14 and the direction of advance is indicated by the arrows 31.

Figure 20:
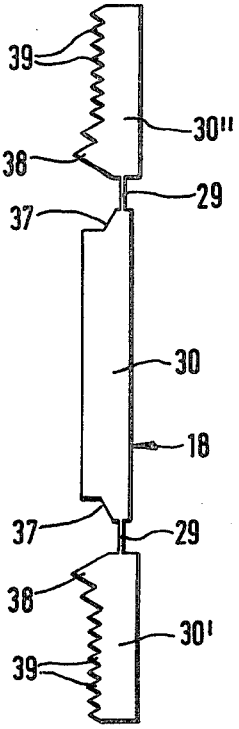
FIG. 20 illustrates a three-part profiled strip prior to installation.

In FIG. 20, a strip 18 is shown in its state prior to mounting. As seen therein, the strip is a shape readily produced by the injection molding or extrusion process. In relation to the handling of the strip 18, the three parts 30, 30', and 30" can be considered a single structural part by virtue of the film hinge.

For the production of fastenings for the lateral parts by means of the emedding of rib ends in the material of the strip, as shown in FIGS. 11 to 20, primarily processes permitting the localized softening of the strip material are suitable. Special emphasis is placed on the ultrasonic process, whereby the generation of heat is enhanced at the boundary layers to be joined with another body, in the present case the radiator core. The joining of synthetic plastic parts by means of ultrasonics is known and is described, for example, in the book "Ultrasonics", by LEHFELDT, Vogel-Verlag, 1973, pages et seq.

The measure according to the invention results in a high strength attachment of lateral parts and very high reliability. As the designer is afforded a degree of freedom in the selection of materials for the lateral parts, light weight materials may be used. Furthermore, the configuration of the strip is arbitrary, so that the different distances of the radiator from the body of the vehicle of any type may be equalized. Also, the peak stresses occurring in the material of lateral parts which are fastened by means of clamped joints are avoided in the arrangement of the invention.

Preferably, profiled strips are used as lateral parts, with a U-shaped strip being used when the joining surfaces are not only on the rib side, and H, L or S-shaped strips being used when the lateral part is employed to cover intermediate spaces and/or is used to fasten additional assemblies.

It is advantageous to provide notches or holes in the area of the rib ends, for the positive joining of the material of the strips with the ribs. In this manner, the strength of the joint may be increased. To increase the joint surface between the ends of the ribs and the lateral part, it is appropriate, in particular, for the adhesive bonding of lateral parts to provide, in the area of the rib ends, a plurality of surfaces extending at least approximately perpendicularly to the longitudinal direction of the ribs and formed by angled parts of the ribs. By means of the partially overlapping angled parts, a uniform, large surface is obtained to which the lateral parts are fastened and whereby a uniform distribution of forces is attained. The measure further provides the heat exchanger with a high torsional rigidity.

Depending on whether or not the width of the ribs is to be preserved during the bending of the parts, the size of the parts to be bent is defined by tabs extending past the edge of the rib proper or by notching the end of the rib. In keeping with the requirements of the individual case and the configuration of the profiled strips, the surfaces may be arranged alternatively on the side of the heat exchanger and/or in the adjacent area of the ribs on the front and rear side of the heat exchanger and/or in slits in the terminal area of the ribs. This enables the designer to locate the joining surfaces, in each case, in the area that is most favorable. With regard to partial lateral parts, this ability to arrange the surfaces means that large joining surfaces, and thus high mechanical strength, may be obtained.

In order to obtain a clean, uniform adhesive bond of high mechanical strength, it is convenient to use, as the adhesive medium, an adhesive tape coated on both sides with a thermosetting adhesive. For this purpose, for example, adhesives hardening in less than one minute at a temperature at approximately 200° C. may be used.

To avoid having to soften the entire volume of the material of the lateral part, it is advantageous to embed each rib end, not over its entire width, but only at two or more small locations. It is proposed for this purpose to provide the strip, on its side facing the ends of the ribs, with projections, which rest, after embedding, in the area of holes, formed in the rib ends.

If the lateral part has the shape of a U or H, with the legs or arms extending alongside the ribs, it is appropriate to embed the ends of angled parts of the ribs in the legs of the shaped strip. In a particularly suitable configuration of a lateral part of this type, the profiled strip comprises two or three parts, with the partition plane extending in the longitudinal direction of the profiled strip and the two parts being welded together. In this manner, even large tolerances of the distance of the legs of the lateral parts may be equalized, and the lateral part may be adapted simply and rapidly to the ends of the ribs. The configuration of the lateral part alongside of each plane of partition is preferably chosen so that one part has a recess and the other part a projection engaging the recess. The recess and the projection may have the shape of a V, and the opening angle of the recess may be substantially larger than the angle of the projection. In order to avoid the need for the individual production and storage of several parts for shaped strips of this type and to prevent errors during the assembly operation, it is advantageous to join the parts by means of a film hinge. An advantageous arrangement for embedding, wherein the strip does not extend over the width of the rib, consists of the rib ends being provided with a dovetail shaped opening whereby a kind of groove is formed along the core of the heat exchanger, to be engaged by a projection on the strip, thus making possible the embedding of the rib ends in the strip through plastic deformation.

In view of the costs of materials and of weight, it is advantageous to make the strip from an extruded or injection molded synthetic plastic material, preferably a thermoplastic material.

The advantage of the present invention lies in the fact that adhesives may be eliminated entirely. Strips of a thermoplastic material are especially suitable for processes of this type. The softening of the zone involved may be effected, for example, by means of ultrasonic applications, friction welding, high frequency or induction heating or by means of heating elements.

What is claimed is:

1. A heat exchanger suitable for use as a radiator in a motor vehicle, comprising:

a plurality of generally parallel tubes;

a plurality of ribs spaced apart and oriented generally parallel to one another in a direction perpendicular to the tubes, and through which the tubes pass, said ribs forming a generally rectangular block having front and back faces and relatively narrower side faces;

a heat exchange medium compartment located at at least one end of the tubes and being in communication with the interior of said tubes; and at least one synthetic resin mounting strip attached to one of said side faces formed by the ends of the ribs, wherein the strip comprises a portion having a generally U-shaped cross section, with the legs of said U-shaped configuration extending along a portion of the front and back faces of said block of ribs and wherein the strip is fastened to said block by having the rib ends embedded into the material of the legs of the strip to provide a positive, interlocking joint between the ribs and the strip.

2. A heat exchanger according to claim 1, wherein the strip comprises at least two parts connected to each other along a hingedly flexible partitioning plane extending in a direction substantially parallel to the axis of the strip.

3. A heat exchanger according to claim 2, wherein the parts of the strip are connected with each other by means of a film hinge.

4. A heat exchanger according to claim 2, wherein said strip comprises 3 parts having a U-shape wherein the parts of said strips forming the legs of the U-shape and being positioned parallel to the longitudinal axis of said rib comprise a plurality of projections engaging said rib end.

5. A heat exchanger according to claim 2, wherein one part of the strip has a recess extending along the partitioning plane and an adjacent part of the strip has a projection with the latter engaging the recess of the former.

6. A heat exchanger according to claim 5, wherein the recess and the projection are in the shape of a V, and the opening angle of the recess is substantially greater than the angle of the projection.

7. A heat exchanger according to claim 1, wherein the rib ends are also embedded into the material of the base portion of said U-shaped configuration of the strip.

8. A heat exchanger according to claim 7, wherein the ribs ends are provided with at least one aperture in the portion embedded into the strip, to ensure a positive connection between the strip and the ribs.

9. A heat exchanger according to claim 8, wherein there is at least one aperture located on each side of the rib end in the portion embedded in said legs.

10. A heat exchanger according to claim 8, wherein the strip has at least one projection on the side of said base portion facing the ribs ends which, after the embedding, surrounds the ribs ends in the area of the aperture.

11. A heat exchanger according to claim 10, wherein there are a plurality of said apertures and a plurality of said projections.

12. A heat exchanger according to claim 1, wherein each of said ribs comprise at least one angled part in the area of said rib ends, said angled part forming a surface extending in a direction approximately perpendicular to the longitudinal direction of said ribs, and wherein said surface contacts said strip, said angled parts extending at least to the next rib and at most to the next two ribs.

13. A heat exchanger according to claim 12, wherein the angled parts do not extend over the entire width of the ribs and at least one aperture is located on each side of the rib end adjacently to the angled part, in the portion of the rib end embedded in said legs.

14. A heat exchanger according to claim 12, wherein said angled parts have been embedded into said strip.

15. A heat exchanger according to claim 1, wherein said strip comprises an extruded strip.

16. A heat exchanger according to claim 1, wherein said strip comprises an injection molded strip.

17. A heat exchanger according to claim 1, wherein said synthetic resin comprises a thermoplastic resin.

* * * * *